US008651172B2

(12) United States Patent
Wyatt et al.

(10) Patent No.: US 8,651,172 B2
(45) Date of Patent: Feb. 18, 2014

(54) SYSTEM AND METHOD FOR SEPARATING COMPONENTS OF A FLUID COOLANT FOR COOLING A STRUCTURE

(75) Inventors: William G. Wyatt, Plano, TX (US); Richard M. Weber, Prosper, TX (US)

(73) Assignee: Raytheon Company, Waltham, MA (US)

( * ) Notice: Subject to any disclaimer, the term of this patent is extended or adjusted under 35 U.S.C. 154(b) by 1789 days.

(21) Appl. No.: 11/689,947

(22) Filed: Mar. 22, 2007

(65) Prior Publication Data

US 2008/0229780 A1 Sep. 25, 2008

(51) Int. Cl.
*F28F 27/00* (2006.01)
*F28D 15/00* (2006.01)

(52) U.S. Cl.
USPC . 165/272; 165/274; 165/104.21; 165/104.33; 62/119; 62/259.2

(58) Field of Classification Search
USPC ..... 165/272, 274, 104.21, 104.33; 62/85, 62/119, 259.2
See application file for complete search history.

(56) References Cited

U.S. PATENT DOCUMENTS

| | | | |
|---|---|---|---|
| 1,528,619 A | 3/1925 | Alphonse | |
| 1,906,422 A | 5/1933 | Roulton | |
| 2,321,964 A | 6/1943 | Zieber | |
| 2,371,443 A | 3/1945 | Harold | |
| 2,991,978 A | 7/1961 | Jones | |
| 3,131,548 A | 5/1964 | Chubb et al. | |
| 3,174,540 A | 3/1965 | Dutton | |
| 3,332,435 A | 7/1967 | Anderson et al. | 137/394 |
| 3,334,684 A | 8/1967 | Roush et al. | 165/47 |
| 3,371,298 A | 2/1968 | Narbut | |
| 3,524,497 A | 8/1970 | Chu et al. | |
| 3,586,101 A | 6/1971 | Chu | |

(Continued)

FOREIGN PATENT DOCUMENTS

| | | |
|---|---|---|
| DE | GB 1220952 | 3/1968 |
| EP | 0 243 239 A2 | 4/1987 |

(Continued)

OTHER PUBLICATIONS

PCT Notification of Transmittal of The International Search Report and the Written Opinion of the International Searching Authority, or the Declaration, PCT/US2009/037912, dated Jun. 22, 2009.

(Continued)

*Primary Examiner* — Ljiljana Ciric

(57) ABSTRACT

A cooling system for a heat-generating structure includes a heating device, a cooling loop, and one or more reservoirs. The heating device is configured to heat fluid coolant comprising a mixture of water and antifreeze and vaporize a portion of the water into vapor while leaving a portion of the antifreeze as liquid in the fluid coolant. The cooling loop has a portion that splits the fluid coolant received from the heating device into a first path configured to receive at least some of the portion of the water as vapor and a second path configured to receive at least some of the portion of the antifreeze as liquid. The one or more reservoirs are configured to receive one of the at least some of the portion of the water as vapor from the first path or the at least some of the portion of the antifreeze as liquid from the second path.

14 Claims, 3 Drawing Sheets

(56) References Cited

U.S. PATENT DOCUMENTS 3,609,991 A 10/1971 Chu et al.
3,731,497 A 5/1973 Ewing ..... 62/160
3,756,903 A 9/1973 Jones
3,774,677 A 11/1973 Antonetti et al.
3,989,102 A 11/1976 Jaster et al.
4,003,213 A 1/1977 Cox
4,019,098 A 4/1977 McCready et al.
4,072,188 A 2/1978 Wilson et al. ..... 165/80
4,129,180 A 12/1978 Larinoff
4,169,356 A 10/1979 Kingham
4,295,341 A 10/1981 Gale
4,296,455 A 10/1981 Leaycraft et al.
4,301,861 A 11/1981 Larinoff
4,312,012 A 1/1982 Frieser et al. ..... 357/82
4,330,033 A 5/1982 Okada et al.
4,381,817 A 5/1983 Brigida et al.
4,411,756 A 10/1983 Bennett et al.
4,495,988 A 1/1985 Grossman
4,511,376 A 4/1985 Coury
4,585,054 A 4/1986 Köprunner
4,619,316 A 10/1986 Nakayama et al. ..... 165/104.33
4,638,642 A 1/1987 Tokuno
4,691,532 A 9/1987 Reid et al. ..... 62/476
4,794,984 A 1/1989 Lin
4,843,837 A 7/1989 Ogawa et al. ..... 62/324.1
4,851,856 A 7/1989 Altoz
4,938,280 A 7/1990 Clark
4,945,980 A 8/1990 Umezawa
4,998,181 A 3/1991 Haws et al.
5,021,924 A 6/1991 Kieda et al.
5,067,560 A 11/1991 Carey et al.
5,086,829 A 2/1992 Asakawa
5,128,689 A 7/1992 Wong et al.
5,148,859 A 9/1992 Beamer
5,158,136 A 10/1992 Azar
5,161,610 A 11/1992 Leidinger
5,168,919 A 12/1992 Berenholz et al.
5,181,395 A 1/1993 Carpenter et al.
5,183,104 A 2/1993 Novotny
5,239,443 A 8/1993 Fahey et al.
5,245,839 A 9/1993 Chang et al.
5,261,246 A 11/1993 Blackmon et al.
5,262,587 A 11/1993 Moser ..... 174/15.1
5,283,715 A 2/1994 Carlsten et al. ..... 361/702
5,297,621 A 3/1994 Taraci et al. ..... 165/104.13
5,333,677 A * 8/1994 Molivadas ..... 165/272
5,353,865 A 10/1994 Adiutori et al.
5,398,519 A 3/1995 Weber et al. ..... 62/201
5,404,272 A 4/1995 Lebailly et al. ..... 361/700
5,406,807 A 4/1995 Ashiwake et al. ..... 62/376
5,414,592 A 5/1995 Stout et al. ..... 361/704
5,447,189 A 9/1995 McIntyre
5,464,325 A 11/1995 Albring et al.
5,493,305 A 2/1996 Wooldridge et al.
5,497,631 A 3/1996 Lorentzen et al.
5,501,082 A 3/1996 Tachibana et al.
5,509,468 A 4/1996 Lopez ..... 165/144
5,515,690 A 5/1996 Blackmon et al.
5,517,825 A * 5/1996 Manz et al. ..... 62/85
5,522,452 A 6/1996 Mizuno et al.
5,605,054 A 2/1997 Chen
5,655,600 A 8/1997 Dewar et al.
5,666,269 A 9/1997 Romero et al.
5,701,751 A 12/1997 Flores
5,726,495 A 3/1998 Aihara et al. ..... 257/722
5,761,037 A 6/1998 Anderson et al.
5,815,370 A 9/1998 Sutton
5,818,692 A 10/1998 Denney, Jr. et al.
5,829,514 A 11/1998 Smith et al.
5,841,564 A 11/1998 McDunn et al.
5,862,675 A 1/1999 Scaringe et al.
5,910,160 A 6/1999 Caakmakci et al.
5,940,270 A 8/1999 Puckett ..... 361/699
5,943,211 A 8/1999 Havey et al.
5,950,717 A 9/1999 Fay
5,960,861 A 10/1999 Price et al.
6,018,192 A 1/2000 Root et al.
6,038,873 A 3/2000 Koo ..... 62/196.4
6,052,284 A 4/2000 Suga et al.
6,052,285 A 4/2000 Hileman ..... 361/699
6,055,154 A 4/2000 Azar
6,173,758 B1 1/2001 Ward et al.
6,205,803 B1 3/2001 Scaringe ..... 62/259.2
6,292,364 B1 9/2001 Fitzgerald et al.
6,297,775 B1 10/2001 Haws et al.
6,305,463 B1 10/2001 Salmonson
6,347,531 B1 2/2002 Roberts et al.
6,349,760 B1 2/2002 Budelman
6,366,462 B1 4/2002 Chu et al.
6,397,932 B1 6/2002 Calaman et al.
6,415,619 B1 7/2002 Bash
6,489,582 B1 12/2002 Roedl et al. ..... 219/69.17
6,498,725 B2 12/2002 Cole et al.
6,519,148 B2 2/2003 Nakagawa et al. ..... 361/679.52
6,519,955 B2 2/2003 Marsala
6,529,377 B1 3/2003 Nelson et al.
6,536,516 B2 3/2003 Davies et al.
6,594,479 B2 7/2003 Ammar et al.
6,603,662 B1 8/2003 Ganrot
6,608,751 B2 8/2003 Ishimine et al. ..... 361/687
6,625,023 B1 9/2003 Morrow et al. ..... 361/700
6,679,081 B2 1/2004 Marsala
6,687,122 B2 2/2004 Monfarad ..... 361/687
6,708,511 B2 3/2004 Martin
6,708,515 B2 3/2004 Malone et al. ..... 62/259.2
6,729,383 B1 5/2004 Cannell et al.
6,744,136 B2 6/2004 Dubhashi ..... 257/714
6,796,372 B2 9/2004 Bear ..... 165/104.21
6,827,135 B1 12/2004 Kramer et al.
6,828,675 B2 12/2004 Memory et al. ..... 257/714
6,866,092 B1 * 3/2005 Molivadas ..... 165/272
6,873,528 B2 3/2005 Hulan et al. ..... 361/719
6,931,834 B2 8/2005 Jones ..... 60/226.1
6,952,345 B2 10/2005 Weber et al.
6,952,346 B2 10/2005 Tilton et al.
6,957,550 B2 * 10/2005 Wyatt et al. ..... 62/259.2
6,967,841 B1 11/2005 Chu et al. ..... 361/700
6,972,365 B2 12/2005 Garner ..... 174/16.3
6,976,527 B2 12/2005 Kirshberg et al.
6,993,926 B2 2/2006 Rini et al. ..... 62/259.2
7,000,691 B1 2/2006 Weber
7,017,358 B2 3/2006 Wayburn et al. ..... 62/115
7,110,260 B2 9/2006 Weber et al. ..... 361/700
7,133,283 B2 11/2006 Faneuf et al. ..... 361/689
7,193,850 B2 3/2007 Pal ..... 361/700
7,227,753 B2 6/2007 Weber et al. ..... 361/700
7,240,494 B2 7/2007 Akei et al. ..... 62/3.2
7,246,658 B2 7/2007 Wyatt et al. ..... 165/274
7,254,957 B2 8/2007 Weber et al.
7,414,843 B2 8/2008 Joshi et al. ..... 361/699
7,508,670 B1 3/2009 Thorson et al. ..... 361/699
7,607,475 B2 10/2009 Weber ..... 165/281
7,626,820 B1 12/2009 Konshak et al. ..... 361/700
7,908,874 B2 * 3/2011 Weber et al. ..... 62/119
7,934,386 B2 * 5/2011 Rummel et al. ..... 62/118
8,490,418 B2 * 7/2013 Weber et al. ..... 62/259.2
2002/0124585 A1 9/2002 Bash et al. ..... 62/228.4
2003/0042003 A1 3/2003 Novotny et al. ..... 165/47
2003/0053298 A1 3/2003 Yamada et al.
2003/0062149 A1 4/2003 Goodson et al.
2004/0231351 A1 11/2004 Wyatt
2005/0262861 A1 * 12/2005 Weber et al. ..... 62/259.2
2005/0274139 A1 12/2005 Wyatt ..... 62/498
2006/0021736 A1 2/2006 Tran
2007/0119199 A1 5/2007 Weber et al. ..... 62/259.2
2007/0119568 A1 * 5/2007 Weber et al. ..... 165/104.33
2007/0209782 A1 9/2007 Wyatt et al. ..... 165/76
2007/0263356 A1 * 11/2007 Weber et al. ..... 165/104.33
2008/0158817 A1 7/2008 Tsunoda et al. ..... 361/697
2008/0291629 A1 11/2008 Ali ..... 361/700
2009/0020266 A1 * 1/2009 Weber et al. ..... 165/104.21
2009/0077981 A1 3/2009 Wyatt et al. ..... 62/3.7
2009/0244830 A1 10/2009 Wyatt et al. ..... 361/679.47

(56) References Cited

U.S. PATENT DOCUMENTS

| | | | | |
|---|---|---|---|---|
| 2010/0001141 | A1 | 1/2010 | Jondeau et al. | 244/158.1 |
| 2010/0076695 | A1* | 3/2010 | Wyatt | 702/24 |
| 2011/0157828 | A1* | 6/2011 | Weber et al. | 165/104.21 |

FOREIGN PATENT DOCUMENTS

| | | | | |
|---|---|---|---|---|
| EP | 02 51 836 | A1 | 5/1987 | |
| EP | 0 817 263 | A2 | 10/1991 | |
| EP | 0 666 214 | A1 | 8/1995 | |
| EP | 1 054 583 | A2 | 11/2000 | H05K 7/20 |
| EP | 1 143 778 | A1 | 10/2001 | |
| EP | 1380 799 | A2 | 5/2003 | |
| EP | 1 381 083 | A2 | 1/2004 | |
| EP | 1 448 040 | A | 8/2004 | |
| EP | 1 601 043 | A | 11/2005 | |
| EP | 1 703 583 | A2 | 9/2006 | |
| EP | 1 627 192 | B1 | 1/2008 | F25B 23/00 |
| FR | 2 730 556 | A1 | 2/1995 | |
| JP | 4-316972 | | 9/1992 | |
| WO | WO 00/65890 | | 2/2000 | |
| WO | WO 02/23966 | | 3/2002 | |
| WO | WO 2007/102978 | | 9/2007 | H05K 7/20 |

OTHER PUBLICATIONS

USPTO; Office Action, U.S. Appl. No. 10/698,953, filed Oct. 31, 2003, in the name of Richard M. Weber; (5 pgs), Date Mailed Dec. 23, 2004.

USPTO; Notice of Allowance and Fees Due, U.S. Appl. No. 10/698,953, filed Oct. 31, 2003, in the name of Richard M. Weber; (7 pgs), Date Mailed Mar. 3, 2005.

USPTO; Non-Final Office Action, U.S. Appl. No. 10/853,038, in the name of Richard M. Weber, (17 pgs), Notification Date Jul. 7, 2006.

USPTO; Final Office Action, U.S. Appl. No. 10/853,038, in the name of Richard M. Weber, (10 pgs), Notification Date Dec. 21, 2006.

USPTO; Adv. Action, U.S. Appl. No. 10/853,038, in the name of Richard M. Weber, (3 pgs), Notification Date Mar. 5, 2007.

USPTO; Final Office Action, U.S. Appl. No. 10/853,038, in the name of Richard M. Weber, (14 pgs), Notification Date Jun. 21, 2007.

USPTO; Advisory Action, U.S. Appl. No. 11/371,681, filed Mar. 8, 2006, William G. Wyatt, (3 pg), Notification Date Aug. 23, 2010.

USPTO; Office Action, U.S. Appl. No. 11/291,041, in the name of Richard M. Weber, (12 pg), Date mailed Jul. 8, 2008.

USPTO; Final Office Action, U.S. Appl. No. 11/291,041, in the name of Richard M. Weber, (12 pg), Date mailed Jan. 29, 2009.

USPTO; Office Action, U.S. Appl. No. 11/339,241, filed Jan. 24, 2006, in the name of Richard M. Weber, (4 pg), Date mailed Aug. 6, 2007.

USPTO; Office Action, U.S. Appl. No. 12/406,645, filed Mar. 18, 2009, in the name of William G. Wyatt, (9 pgs), Notification Date Feb. 23, 2010.

USPTO; Notice of Allowance and Fees Due, U.S. Appl. No. 12/406,645, filed Mar. 18, 2009, in the name of William G. Wyatt, (7 pgs), Notification Date Jul. 1, 2010.

European Search Report for International Application No. PCT/US2007/008842; 9 pages, Oct. 5, 2007.

Kharazi, et al., "Implementation of 3-Port Condensing Wave Rotors in R718 Cycles", Journal of Energy Resources Technology, Dec. 2006, vol. 128, pp. 325-334.

Karazi, et al. "An Application of Wave Rotor Technology for Performance Enhancement of R718 Refrigeration Cycles", The American Institute of Aeronautics and Astronautics, Inc., pp. 965-977.

Kharazi, et al., "Performance Benefits of R718 Turbo-Compression Cycle Using 3-Port Condensing Wave Rotors", Proceedings of IMECE04; 2004 ASME International Mechanical Engineering Congress and Exposition, Nov. 13-20, 2004, pp. 167-176.

Kharazi, et al., "Preliminary Study of a Novel R718 Turbo-Compression Cycle Using a 3-Port Condensing Wave Rotor", Proceedings of ASME Turbo Expo. 2004, Jun. 14-17, 2004.

Kharazi, et al., "Preliminary Study of a Novel R718 Compression Refrigeration Cycle Using a Three-Port Condensing Wave Rotor", Journal of Engineering for Gas Turbines and Power, Jul. 2005, vol. 127, pp. 539-544.

Akbari, et al., "A Review of Wave Rotor Technology and Its Applications", Proceedings of IMEC04, 2004 ASME International Mechanical Engineering Congress and Exposition, Nov. 13-20, 2004, IMECE2004-60082, pp. 81-103.

Kilicarslan, et al., "A comparative study of water as a refrigerant with some current refrigerants", International Journal of Energy Research, pp. 948-959, 2005.

Akbari, et al., "Utilizing Wave Rotor Technology to Enhance the Turbo Compression in Power and Refrigeration Cycles", Proceedings of IMECE'03, 2003 ASME International Mechanical Engineering, Nov. 16-21, 2003.

European Patent Office Communication, dated Mar. 20, 2008, Reference JL36895P.EPP, 6 pages.

Application Bulletin #16; "Water Purity Requirements in Liquid Cooling Systems;" Jun. 12, 1995; 4 pages.

European Search Report dated Jan. 13, 2012 in connection with European Patent Application No. EP 08 00 5311.

Margaret Ingels, (pp. 59 and 80 of Willis Haviland Carrier "*Father of Air Conditioning*", Country Life Press—Garden City (1952).

Dirk Van Orshoven, "*The use of water as a refrigerant—an exploratory investigation*", Thesis University Wisconsin, 1991, pp. I, III-XIII, 1-114.

"An Integrated Thermal Architecture for Thermal Management of High Power Electronics", High Power Electronics, http:www.coolingzone.com/Guest/News/NL_JAN_2003/Thermacore/ Thermacore Jan. 2003, 22 pages.

Beaty, et al., "New Guidelines for Data Center Cooling", Dec. 2003; 8 pages.

Wilson, et al., "A Thermal Bus System for Cooling Electronic Components in High-Density Cabinets", 2004 AHSRAE Transactions; Symposia, pp. 567-573.

Center for the Analysis and Dissemination of Demonstrated Energy Technology (CADDET), Cooling plant at LEGO uses water as refrigerant, Sep. 1997.

Muller, Norbert, Ph.D. Turbo Chillers using Water as a Refrigerant, Michigan State University, AMSE Process Industry Division PID Newsletter, Fall 2002, p. 3.

Maab, Jurgen and Feddeck, Paul, BINE Projectinfo, BINE Informationsdienst, Wasser als Kaltemittel, Aug. 2003.

Kharzi, A., Ph.D., Preliminary Study of a Novel R718 Turbo-Compression Cycle using a 3-port condensing wave rotor, 2004 International ASME Turbo Exposition, ASME Paper GT2004-53622, Austria, Jun. 2004.

"Subcooled Flow Boiling With Flow Pattern Control" IBM Technical Disclosure Bulletin, vol. 22, Issue 5, pp. 1843-1844 Oct. 1, 1979.

U.S. Appl. No. 10/193,571, filed Jul. 11, 2002, entitled "Method and Apparatus for Removing Heat from a Circuit", 33 pages of text and 3 pages of drawings.

U.S. Appl. No. 10/192,891, filed Jul. 11, 2002 by inventor Richard M. Weber for "Method and Apparatus for Cooling with Coolant at a Subambient Pressure", 21 pages of text and 2 pages of drawings.

U.S. Appl. No. 10/440,716, filed May 19, 2003 by inventors William Gerald Wyatt and Richard M. Weber for "Method and Apparatus for Extracting Non-Condensable Gases in a Cooling System", 21 pages of text and 1 drawing sheet.

U.S. Appl. No. 10/853,038, filed May 25, 2004 by inventors Richard M. Weber, et al. for "Method and Apparatus for Controlling Cooling with Coolant at a Subambient Pressure" 25 pages of text and 4 drawing sheets.

U.S. Appl. No. 11/058,691, filed Feb. 15, 2005 by inventors Weber, et al., "Method and Apparatus for Cooling with Coolant at a Subambient Pressure", 28 pages.

PCT Notification of Transmittal of The International Search Report or the Declaration dated Sep. 27, 2004 for PCT/US2004/015086.

EPO Search Report dated Oct. 25, 2004 for Patent No. 03254283.9-2203; Reference No. JL3846.

EPO Search Report dated Nov. 3, 2004 for Patent No. 03254285.4-2301; Reference No. JL3847.

(56) References Cited

OTHER PUBLICATIONS

EP Search Report dated May 4, 2005 for European Patent Application No. EP 04256509.3.
EP Search Report dated Mar. 4, 2005 for European Patent Application No. EP 04256509.3-2220.
Notification of Transmittal of the International Search Report and the Written Opinion of the International Searching Authority or the Declaration Int'l Application No. PCT/US2005/1020544; date of mailing: Oct. 10, 2005; Int'l filing date Jun. 10, 2005; 3 pages.
"International Search Report", Int'l Application No. PCT/US2005/020544; Earliest Priority Date: Jun. 14, 2004; Int'l filing date: Jun. 10, 2005; 5 pages.
"Written Opinion of the International Searching Authority," Int'l Application No. PCT/US2005/020544; Earliest Priority Date: Jun. 14, 2004; Int'l filing date: Jun. 10, 2005; 9 pages.
USPTO; Office Action for U.S. Appl. No. 11/381,297, filed May 2, 2006, in the name of Richard M. Weber; (16 pgs.), Notification Date Apr. 21, 2010.
USPTO; Advisory Action for U.S. Appl. No. 11/381,297, filed May 2, 2006, in the name of Richard M. Weber; (3 pgs.), Notification Date Mar. 24, 2010.
USPTO; Final Office Action for U.S. Appl. No. 11/381,297, filed May 2, 2006, in the name of Richard M. Weber; (16 pgs.), Notification Date Jan. 12, 2010.
USPTO; Office Action for U.S. Appl. No. 11/381,297, filed May 2, 2006, in the name of Richard M. Weber; (12 pgs.), Notification Date Jun. 1, 2009.
USPTO; Office Action for U.S. Appl. No. 11/381,297, filed May 2, 2006, in the name of Richard M. Weber; (7 pgs.), Notification Date Jan. 29, 2009.
USPTO; Office Action for U.S. Appl. No. 11/371,681, filed Mar. 8, 2006, in the name of William G. Wyatt; (8 pgs.), Notification Date Dec. 10, 2009.
USPTO; Office Action for U.S. Appl. No. 11/371,681, filed Mar. 8, 2006, in the name of William G. Wyatt; (8 pgs.), Notification Date Aug. 5, 2009.
USPTO; Office Action for U.S. Appl. No. 11/371,681, filed Mar. 8, 2006, in the name of William G. Wyatt; (7 pgs.), Notification Date Jun. 8, 2010.
USPTO; Office Action for U.S. Appl. No. 11/859,591, filed Sep. 21, 2007, in the name of William G. Wyatt; (13 pgs.), Notification Date Aug. 3, 2009.
USPTO; Final Office Action for U.S. Appl. No. 11/859,591, filed Sep. 21, 2007, in the name of William G. Wyatt; (13 pgs.), Notification Date Feb. 18, 2010.
USPTO; Notice of Allowance and Fee(s) Due for U.S. Appl. No. 11/859,591, filed Sep. 21, 2007, in the name of William G. Wyatt; (4 pgs.), Date Mailed: Jul. 8, 2010.
USPTO; Notice of Allowance and Fee(s) Due for U.S. Appl. No. 10/192,891, filed Jul. 11, 2002, in the name of Richard M. Weber; (6 pgs.), Date Mailed Sep. 12, 2005.
USPTO; Office Action for U.S. Appl. No. 10/192,891, filed Jul. 11, 2002, in the name of Richard M. Weber; (6 pgs.), Date Mailed Jan. 12, 2005.
USPTO; Office Action for U.S. Appl. No. 10/192,891, filed Jul. 11, 2002, in the name of Richard M. Weber; (5 pgs.), Date Mailed Mar. 4, 2004.
USPTO; Office Action for U.S. Appl. No. 10/192,891, filed Jul. 11, 2002, in the name of Richard M. Weber; (4 pgs.), Date Mailed Sep. 30, 2003.
USPTO; Notice of Allowance and Fee(s) Due for U.S. Appl. No. 10/193,571, filed Jul. 11, 2002, in the name of James L. Haws; (4 pgs.), Date Mailed Jun. 6, 2005.
USPTO; Office Action for U.S. Appl. No. 10/193,571, filed Jul. 11, 2002, in the name of James L. Haws; (7 pgs.), Date Mailed Feb. 1, 2005.
USPTO; Notice of Allowance and Fee(s) Due for U.S. Appl. No. 10/193,571, filed Jul. 11, 2002, in the name of James L. Haws; (4 pgs.), Date Mailed May 21, 2004.
USPTO; Final Office Action for U.S. Appl. No. 10/193,571, filed Jul. 11, 2002, in the name of James L. Haws; (8 pgs.), Date Mailed Mar. 3, 2004.
USPTO; Office Action for U.S. Appl. No. 10/193,571, filed Jul. 11, 2002, in the name of James L. Haws; (6 pgs.), Date Mailed Oct. 20, 2003.
USPTO; Notice of Allowance and Fee(s) Due for U.S. Appl. No. 10/440,716, filed May 19, 2003, in the name of William Gerald Wyatt; (6 pgs.), Date Mailed Jun. 1, 2005.
USPTO; Final Office Action for U.S. Appl. No. 10/440,716, filed May 19, 2003, in the name of William Gerald Wyatt; (6 pgs.), Date Mailed Mar. 3, 2005.
USPTO; Office Action for U.S. Appl. No. 10/440,716, filed May 19, 2003, in the name of William Gerald Wyatt; (5 pgs.), Date Mailed Oct. 22, 2004.
USPTO; Office Action for U.S. Appl. No. 10/440,716, filed May 19, 2003, in the name of William Gerald Wyatt; (9 pgs.), Date Mailed Jun. 10, 2004.
USPTO; Notice of Allowance and Fee(s) Due for U.S. Appl. No. 11/058,691, filed Feb. 15, 2005, in the name of Richard Martin Weber; (5 pgs.), Date Mailed Apr. 9, 2007.
USPTO; Office Action for U.S. Appl. No. 11/058,691, filed Feb. 15, 2005, in the name of Richard Martin Weber; (5 pgs.), Notification Date Jan. 2, 2007.
USPTO; Office Action for U.S. Appl. No. 11/154,107, filed Jun. 15, 2005, in the name of Richard M. Weber; (6 pgs.), Date mailed Dec. 23, 2005.
USPTO; Notice of Allowance and Fee(s) Due for U.S. Appl. No. 11/154,107, filed Jun. 15, 2005, in the name of Richard M. Weber; (5 pgs.), Date Mailed May 17, 2006.
USPTO; Notice of Allowance and Fee(s) Due for U.S. Appl. No. 11/533,219, filed Sep. 19, 2006, in the name of Richard M. Weber; (8 pgs.), Date Mailed Jan. 31, 2007.
USPTO; Office Action, for U.S. Appl. No. 10/867,331, filed Jun. 14, 2004, in the name of William G. Wyatt, (10 pgs.), Notification Date Jan. 19, 2010.
USPTO; Final Office Action, for U.S. Appl. No. 10/867,331, filed Jun. 14, 2004, in the name of William G. Wyatt, (11 pgs.), Notification Date May 17, 2010.
USPTO; Office Action, U.S. Appl. No. 11/339,241, filed Jan. 24, 2006, in the name of Richard M. Weber, (10 pgs), Notification Date Oct. 9, 2007.
USPTO; Notice of Allowance and Fees Due, U.S. Appl. No. 11/339,241, filed Jan. 24, 2006, in the name of Richard M. Weber, (7 pgs), Notification Date Jun. 15, 2009.
European Patent Office; Communication Pursuant to Article 94(3) EPC for Application No. 07 755 199.2-2301; Ref. JL 55728P EPP (4 pages), Jun. 10, 2010.
"Heating, Ventilating, and Air-Conditioning Applications", 1999 Ashrae Handbook, Atlanta, SI Edition, Chapter 47—Water Treatment, http://ww.ashrae.org, pp. 47.1-47.11 (12 pgs), 1999.
Notification of Transmittal of The International Search Report and The Written Opinion of the International Searching Authority, or the Declaration; PCT/US2007/004146; dated Jul. 31, 2007; 6 pages.

* cited by examiner

SYSTEM AND METHOD FOR SEPARATING COMPONENTS OF A FLUID COOLANT FOR COOLING A STRUCTURE

TECHNICAL FIELD OF THE INVENTION

This invention relates generally to the field of cooling systems and, more particularly, to a system and method for separating components of a fluid coolant for cooling a structure.

BACKGROUND OF THE INVENTION

A variety of different types of structures can generate heat or thermal energy in operation. To prevent such structures from over heating, a variety of different types of cooling systems may be utilized to dissipate the thermal energy. Certain cooling systems utilize water as a coolant. To prevent the water from freezing, the water may be mixed with antifreeze.

SUMMARY OF THE INVENTION

According to one embodiment of the invention, a cooling system for a heat-generating structure includes a heating device, a cooling loop, and a separation structure. The heating device heats a flow of fluid coolant including a mixture of water and antifreeze. The cooling loop includes a director structure which directs the flow of the fluid coolant substantially in the form of a liquid to the heating device. The heating device vaporizes a substantial portion of the water into vapor while leaving a substantial portion of the antifreeze as liquid. The separation structure receives, from the heating device, the flow of fluid coolant with the substantial portion of the water as vapor and the substantial portion of the antifreeze as liquid. The separation structure separates one of the substantial portion of the water as vapor or the substantial portion of the antifreeze as liquid from the cooling loop while allowing the other of the substantial portion of the water as vapor or the substantial portion of the antifreeze as liquid to remain in the cooling loop.

Certain embodiments of the invention may provide numerous technical advantages. For example, a technical advantage of one embodiment may include the capability to separate a fluid coolant including a mixture of antifreeze and water into a fluid coolant including substantially only water and a fluid coolant including substantially only antifreeze. Other technical advantages of other embodiments may include using only the fluid coolant including substantially only water to cool a heat-generating structure. Still yet other technical advantages of other embodiments may include the capability to remix the fluid coolant including substantially only water with the fluid coolant including substantially only antifreeze.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION OF EXAMPLE EMBODIMENTS OF THE INVENTION

It should be understood at the outset that although example embodiments of the present invention are illustrated below, the present invention may be implemented using any number of techniques, whether currently known or in existence. The present invention should in no way be limited to the example embodiments, drawings, and techniques illustrated below, including the embodiments and implementation illustrated and described herein. Additionally, the drawings are not necessarily drawn to scale.

Conventionally, cooling systems may be used to cool server based data centers or other commercial and military applications. Although these cooling systems may minimize a need for conditioned air, they may be limited by their use of either a fluid coolant including only water or a fluid coolant including a mixture of antifreeze and water.

Figure 1:
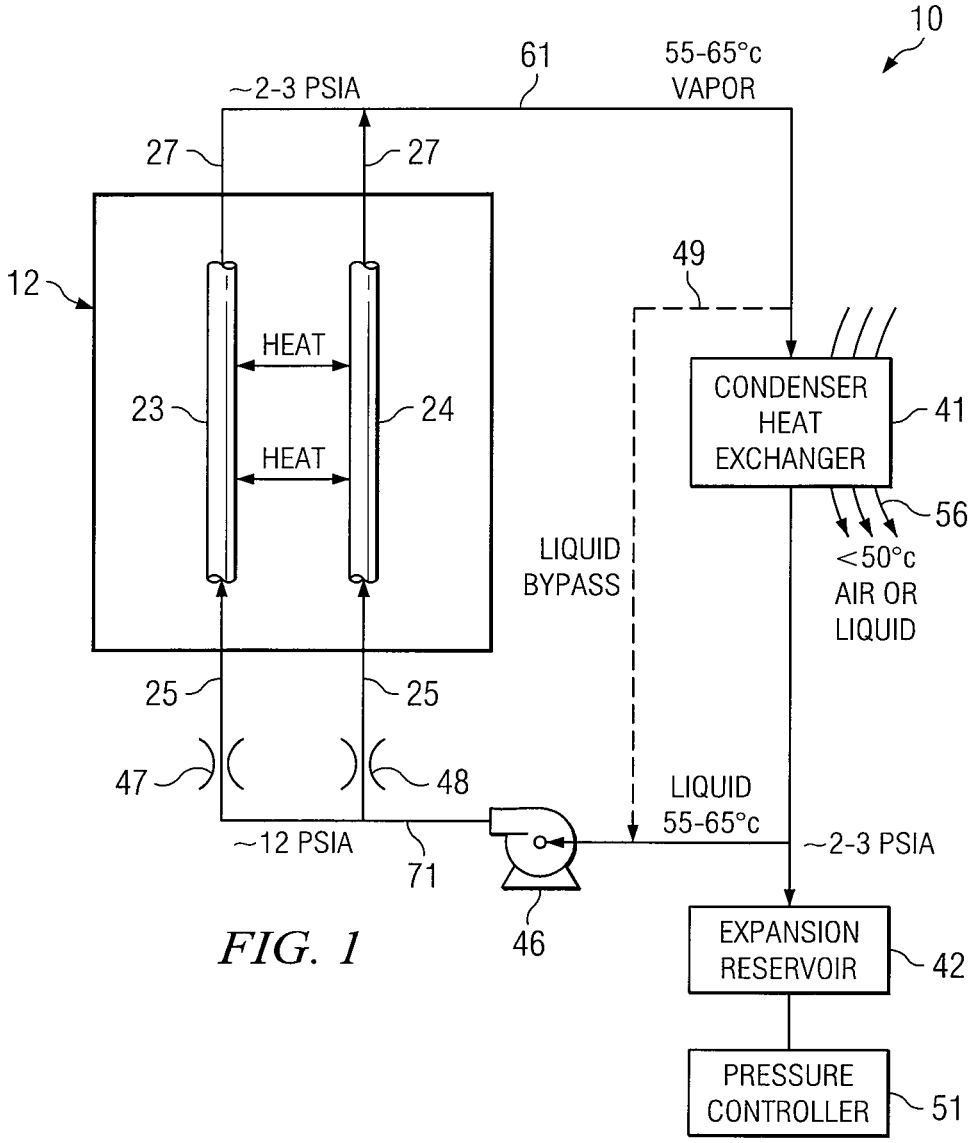
FIG. 1 is a block diagram of an embodiment of a cooling system that may be utilized in conjunction with embodiments of the present invention.

FIG. 1 is a block diagram of an embodiment of a conventional cooling system that may be utilized in conjunction with embodiments of the present invention. Although the details of one cooling system will be described below, it should be expressly understood that other cooling systems may be used in conjunction with embodiments of the invention.

The cooling system 10 of FIG. 1 is shown cooling a structure 12 that is exposed to or generates thermal energy. The structure 12 may be any of a variety of structures, including, but not limited to, electronic components, circuits, computers, and servers. Because the structure 12 can vary greatly, the details of structure 12 are not illustrated and described. The cooling system 10 of FIG. 1 includes a vapor line 61, a liquid line 71, heat exchangers 23 and 24, a loop pump 46, inlet orifices 47 and 48, a condenser heat exchanger 41, an expansion reservoir 42, and a pressure controller 51.

The structure 12 may be arranged and designed to conduct heat or thermal energy to the heat exchangers 23, 24. To receive this thermal energy or heat, the heat exchanger 23, 24 may be disposed on an edge of the structure 12 (e.g., as a thermosyphon, heat pipe, or other device) or may extend through portions of the structure 12, for example, through a thermal plane of structure 12. In particular embodiments, the heat exchangers 23, 24 may extend up to the components of the structure 12, directly receiving thermal energy from the components. Although two heat exchangers 23, 24 are shown in the cooling system 10 of FIG. 1, one heat exchanger or more than two heat exchangers may be used to cool the structure 12 in other cooling systems.

In operation, a fluid coolant flows through each of the heat exchangers 23, 24. As discussed later, this fluid coolant may be a two-phase fluid coolant, which enters inlet conduits 25 of heat exchangers 23, 24 in liquid form. Absorption of heat from the structure 12 causes part or all of the liquid coolant to boil and vaporize such that some or all of the fluid coolant leaves the exit conduits 27 of heat exchangers 23, 24 in a vapor phase. To facilitate such absorption or transfer of thermal energy, the heat exchangers 23, 24 may be lined with pin fins or other similar devices which, among other things, increase surface contact between the fluid coolant and walls of the heat exchangers 23, 24. Additionally, in particular embodiments, the fluid coolant may be forced or sprayed into the heat exchangers 23, 24 to ensure fluid contact between the fluid coolant and the walls of the heat exchangers 23, 24.

The fluid coolant departs the exit conduits 27 and flows through the vapor line 61, the condenser heat exchanger 41, the expansion reservoir 42, a loop pump 46, the liquid line 71, and a respective one of two orifices 47 and 48, in order to again to reach the inlet conduits 25 of the heat exchanger 23, 24. The loop pump 46 may cause the fluid coolant to circulate around the loop shown in FIG. 1. In particular embodiments, the loop pump 46 may use magnetic drives so there are no shaft seals that can wear or leak with time. Although the vapor line 61 uses the term "vapor" and the liquid line 71 uses the terms "liquid", each respective line may have fluid in a different phase. For example, the liquid line 71 may have contain some vapor and the vapor line 61 may contain some liquid.

The orifices 47 and 48 in particular embodiments may facilitate proper partitioning of the fluid coolant among the respective heat exchanger 23, 24, and may also help to create a large pressure drop between the output of the loop pump 46 and the heat exchanger 23, 24 in which the fluid coolant vaporizes. The orifices 47 and 48 may have the same size, or may have different sizes in order to partition the coolant in a proportional manner which facilitates a desired cooling profile.

A flow 56 of fluid (either gas or liquid) may be forced to flow through the condenser heat exchanger 41, for example by a fan (not shown) or other suitable device. In particular embodiments, the flow 56 of fluid may be ambient fluid. The condenser heat exchanger 41 transfers heat from the fluid coolant to the flow 56 of ambient fluid, thereby causing any portion of the fluid coolant which is in the vapor phase to condense back into a liquid phase. In particular embodiments, a liquid bypass 49 may be provided for liquid fluid coolant that either may have exited the heat exchangers 23, 24 or that may have condensed from vapor fluid coolant during travel to the condenser heat exchanger 41. In particular embodiments, the condenser heat exchanger 41 may be a cooling tower.

The liquid fluid coolant exiting the condenser heat exchanger 41 may be supplied to the expansion reservoir 42. Since fluids typically take up more volume in their vapor phase than in their liquid phase, the expansion reservoir 42 may be provided in order to take up the volume of liquid fluid coolant that is displaced when some or all of the coolant in the system changes from its liquid phase to its vapor phase. The amount of the fluid coolant which is in its vapor phase can vary over time, due in part to the fact that the amount of heat or thermal energy being produced by the structure 12 will vary over time, as the structure 12 system operates in various operational modes.

Turning now in more detail to the fluid coolant, one highly efficient technique for removing heat from a surface is to boil and vaporize a liquid which is in contact with a surface. As the liquid vaporizes in this process, it inherently absorbs heat to effectuate such vaporization. The amount of heat that can be absorbed per unit volume of a liquid is commonly known as the latent heat of vaporization of the liquid. The higher the latent heat of vaporization, the larger the amount of heat that can be absorbed per unit volume of liquid being vaporized.

The fluid coolant used in the embodiment of FIG. 1 may include, but is not limited to, mixtures of antifreeze and water or water, alone. In particular embodiments, the antifreeze may be ethylene glycol, propylene glycol, methanol, or other suitable antifreeze. In other embodiments, the mixture may also include fluoroinert. In particular embodiments, the fluid coolant may absorb a substantial amount of heat as it vaporizes, and thus may have a very high latent heat of vaporization.

Water boils at a temperature of approximately 100° C. at an atmospheric pressure of 14.7 pounds per square inch absolute (psia). In particular embodiments, the fluid coolant's boiling temperature may be reduced to between 55-65° C. by subjecting the fluid coolant to a subambient pressure of about 2-3 psia. Thus, in the cooling system 10 of FIG. 1, the orifices 47 and 48 may permit the pressure of the fluid coolant downstream from them to be substantially less than the fluid coolant pressure between the loop pump 46 and the orifices 47 and 48, which in this embodiment is shown as approximately 12 psia. The pressure controller 51 maintains the coolant at a pressure of approximately 2-3 psia along the portion of the loop which extends from the orifices 47 and 48 to the loop pump 46, in particular through the heat exchangers 23 and 24, the condenser heat exchanger 41, and the expansion reservoir 42. In particular embodiments, a metal bellows may be used in the expansion reservoir 42, connected to the loop using brazed joints. In particular embodiments, the pressure controller 51 may control loop pressure by using a motor driven linear actuator that is part of the metal bellows of the expansion reservoir 42 or by using small gear pump to evacuate the loop to the desired pressure level. The fluid coolant removed may be stored in the metal bellows whose fluid connects are brazed. In other configurations, the pressure controller 51 may utilize other suitable devices capable of controlling pressure.

In particular embodiments, the fluid coolant flowing from the loop pump 46 to the orifices 47 and 48 through liquid line 71 may have a temperature of approximately 55° C. to 65° C. and a pressure of approximately 12 psia as referenced above. After passing through the orifices 47 and 48, the fluid coolant may still have a temperature of approximately 55° C. to 65° C., but may also have a lower pressure in the range about 2 psia to 3 psia. Due to this reduced pressure, some or all of the fluid coolant will boil or vaporize as it passes through and absorbs heat from the heat exchanger 23 and 24.

After exiting the exits ports 27 of the heat exchanger 23, 24, the subambient coolant vapor travels through the vapor line 61 to the condenser heat exchanger 41 where heat or thermal energy can be transferred from the subambient fluid coolant to the flow 56 of fluid. The flow 56 of fluid in particular embodiments may have a temperature of less than 50° C. In other embodiments, the flow 56 may have a temperature of less than 40° C. As heat is removed from the fluid coolant, any portion of the fluid which is in its vapor phase will condense such that substantially all of the fluid coolant will be in liquid form when it exits the condenser heat exchanger 41. At this point, the fluid coolant may have a temperature of approximately 55° C. to 65° C. and a subambient pressure of approximately 2 psia to 3 psia. The fluid coolant may then flow to loop pump 46, which in particular embodiments, loop pump 46 may increase the pressure of the fluid coolant to a value in the range of approximately 12 psia, as mentioned earlier. Prior to the loop pump 46, there may be a fluid connection to an expansion reservoir 42 which, when used in conjunction with the pressure controller 51, can control the pressure within the cooling loop.

It will be noted that the embodiment of FIG. 1 may operate without a refrigeration system. In the context of electronic circuitry, such as may be utilized in the structure 12, the absence of a refrigeration system can result in a significant reduction in the size, weight, and power consumption of the structure provided to cool the circuit components of the structure 12.

As discussed above with regard to FIG. 1, the fluid coolant of the cooling system 10 may include mixtures of antifreeze and water or water, alone. A fluid coolant including only water has a heat transfer coefficient substantially higher than a fluid coolant including a mixture of antifreeze and water. As a result, more heat transfer may occur with a fluid coolant including only water. Thus, in certain embodiments, a heat-generating structure may be cooled more efficiently using a fluid coolant including only water. However, certain embodiments of the cooling system 10 are used in various commercial and military applications that subject the fluid coolant to temperatures equal to or below 0° C. Because water has a freezing point of 0° C., difficulties may arise when using water alone as a fluid coolant, especially when the heat-generating structure is not generating heat, such as when it is turned off.

On the other hand, mixing antifreeze with water substantially lowers the freezing point of the fluid coolant. Therefore, a fluid coolant including a mixture of antifreeze and water may be used in many environments where a fluid coolant including only water incurs difficulties. However, as discussed above, mixing antifreeze with water lowers the heat transfer coefficient of the fluid coolant, resulting in a less efficient way to cool a heat-generating structure.

Conventionally, these problems have been addressed by using a fluid coolant including a mixture of antifreeze and water and accepting the less efficient heat transfer, or using a fluid coolant including only water and removing the fluid coolant from the cooling loop when not in use. Accordingly, teachings of some embodiments of the invention recognize a cooling system for a heat generating structure including a flow of fluid coolant comprising a mixture of water and antifreeze, the system capable of separating the antifreeze and the water.

Figure 2:
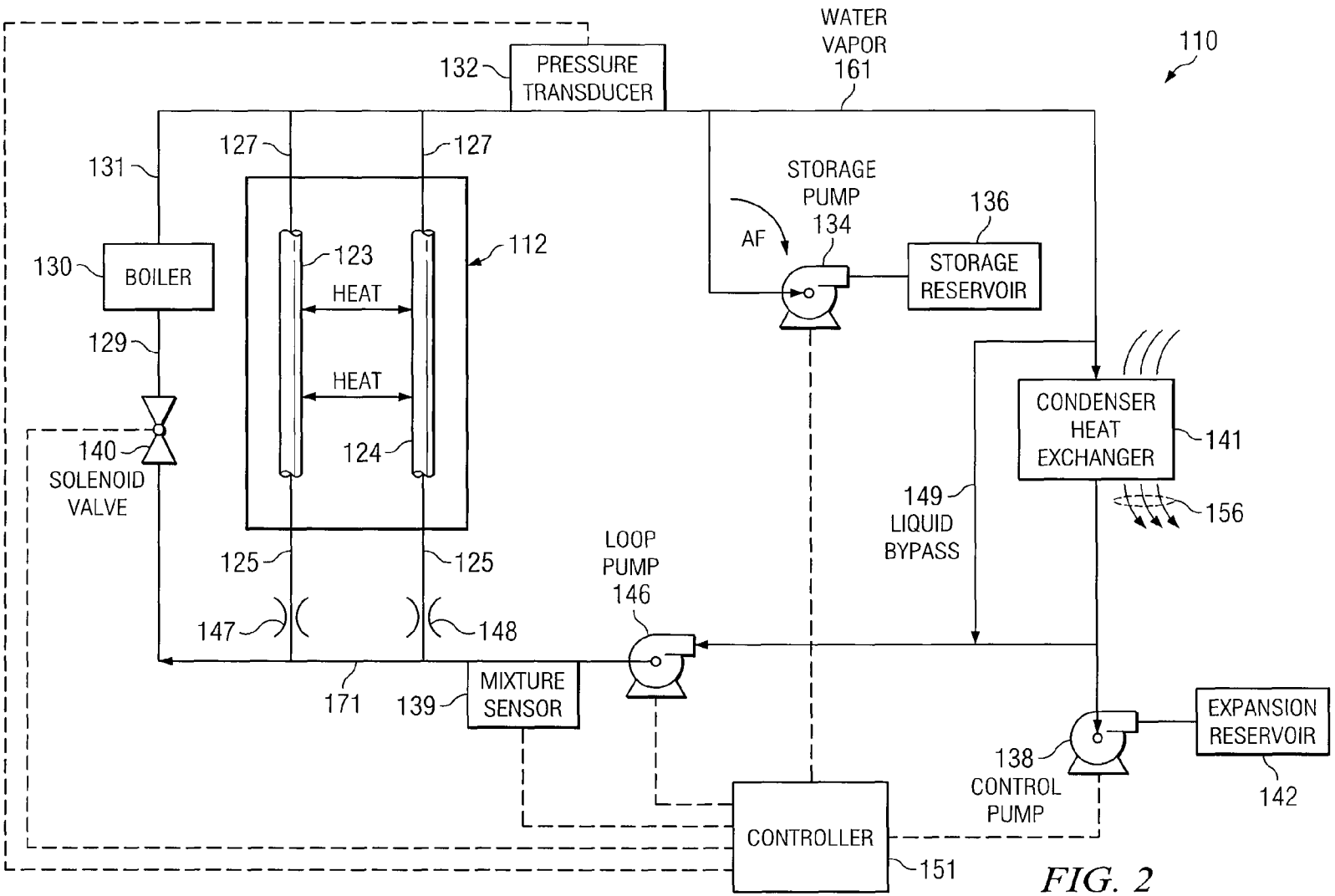
FIG. 2 is a block diagram of a cooling system for cooling a heat-generating structure, according to an embodiments of the invention.

FIG. 2 is a block diagram of an embodiment of a cooling system 110 for cooling a heat-generating structure, according to an embodiment of the invention. In one embodiment, the cooling system 110 includes a heating device 130 for heating a flow of fluid coolant including a mixture of antifreeze and water. The heating device 130, in one embodiment, vaporizes a substantial portion of the water into vapor while leaving a substantial portion of the antifreeze as liquid. In another embodiment, the cooling system 110 further includes a storage reservoir 136 for storing the substantial portion of the antifreeze as liquid. In certain embodiments, this allows the cooling system 110 to separate a fluid coolant including a mixture of antifreeze and water into a fluid coolant including substantially only water and a fluid coolant including substantially only antifreeze. According to one embodiment of the cooling system 110, the fluid coolant including substantially only water is used to cool a heat-generating structure. In another embodiment, the cooling system 110 includes a storage pump 134 for mixing the fluid coolant including substantially only water with the fluid coolant including substantially only antifreeze.

The cooling system 110 of FIG. 2 is similar to the cooling system 10 of FIG. 1 except that the cooling system 110 of FIG. 2 further includes the heating device 130, the storage pump 134, the storage reservoir 136, a control pump 138, a mixture sensor 139, and a solenoid valve 140.

The heating device 130 may include a heat structure operable to heat a fluid coolant. In one embodiment, the heating device 130 may be a heat-generating structure, a boiler, or any other structure operable to heat the fluid coolant. In a further embodiment, the heating device 130 may further include a structure 112. The structure 112 is similar to the structure 12 of FIG. 1.

The cooling system 110 may further include a fluid coolant including, but not limited to, a mixture of antifreeze and water. A fluid coolant comprising a mixture of antifreeze and water may have a freezing point range between −40° C. and −50° C. In one embodiment, this freezing point range occurs in a fluid coolant when the fluid coolant comprises a mixture between 60:40 and 50:50 (antifreeze:water). In certain embodiments, the lower freezing point of the fluid coolant prevents the fluid coolant from freezing when not being used in the cooling system 110 to cool the structure 112.

In operation, the heating device 130 is turned on, causing it to generate heat. The structure 112, in one embodiment, is not activated when the heating device 130 is turned on. A fluid coolant including a mixture of antifreeze and water enters the heating device 130, in liquid form, through a heating device inlet conduit 129. At the heating device 130, absorption of heat from the heating device 130 causes the water in the fluid coolant to substantially vaporize. The antifreeze in the fluid coolant, however, remains substantially in liquid form. In one embodiment, the antifreeze remains in liquid form because antifreeze has a lower vapor pressure than water.

Once heated, the fluid coolant, which includes both vapor consisting substantially of water and liquid consisting substantially of antifreeze, departs a heating device outlet conduit 131 and flows through a vapor line 161. The vapor line 161 is similar to the vapor line 61 of FIG. 1. As vapor is produced by the heating device 130, the pressure of the loop is sensed by a pressure transducer 132, which includes a feedback to a pressure controller 151. The pressure controller 151 is similar to pressure controller 51 of FIG. 1. As a result, the pressure controller 151 commands the storage pump 134 to pull the fluid coolant in liquid form, consisting substantially of antifreeze, from the loop. In one embodiment, the fluid coolant in liquid form is stored in the storage reservoir 136. In another embodiment, the rate at which the storage pump 134 pulls the fluid coolant in liquid form from the loop is commensurate to the rate of vapor produced by the heating device 130. In one embodiment, this keeps the cooling loop pressure within a preset range.

The fluid coolant in vapor form, which includes substantially only water, flows through the condenser heat exchanger 141, the expansion reservoir 142, the loop pump 146, and the liquid line 171, in order to, once again, reach the heating device inlet conduit 129 of the heating device 130. The condenser heat exchanger 141, the expansion reservoir 142, the loop pump 146, and the liquid line 171 of FIG. 2 are similar to the heat exchanger 41, the expansion reservoir 42, the loop pump 46, and the liquid line 71, respectively, of FIG. 1.

The condenser heat exchanger 141 transfers heat from the fluid coolant to a flow 156 of ambient fluid, thereby causing any portion of fluid coolant which is in the vapor phase to condense back into a liquid phase. The flow 156 of FIG. 2 is similar to the flow 56 of FIG. 1. In particular embodiments, a liquid bypass 149 may be provided for fluid coolant in liquid form that was not pulled into the storage reservoir 136 by the storage pump 134, or that may have condensed from vapor during travel to the condenser heat exchanger 141.

In order to keep the cooling loop within a desired range of pressure, the control pump 138 may remove the liquid fluid coolant exiting the condenser heat exchanger 141. The liquid fluid coolant removed by the control pump 138 is stored, in one embodiment, in the expansion reservoir 142.

The liquid fluid coolant not removed by the control pump 138 flows back to the heating device 130 through the heating device inlet conduit 129. At the heating device 130, the liquid fluid coolant is, once again, heated, and the separation process repeats. In one embodiment, this process may repeat until the feedback from the mixture sensor 139 reaches a predetermined level of mixture of the fluid coolant. In one embodiment, the predetermined mixture level may be where the fluid coolant in the loop is within a range of 0-5% antifreeze. In another embodiment, the predetermined mixture may be where the fluid coolant in the loop is 5% antifreeze.

Once the predetermined mixture level is met, the controller 151 commands the solenoid valve 140 to close. In one embodiment, this prevents the fluid coolant from flowing into the heating device 130. When the solenoid valve 140 is closed, the fluid coolant, which now includes substantially only water, may now flow through inlet orifices 147 and 148, the inlet conduits 125, the heat exchangers 123 and 124, and the exit conduits 127. The inlet orifices 147 and 148, the inlet conduits 125, the heat exchangers 123 and 124, and the exit conduits 127 of FIG. 2 are similar to the inlet orifices 47 and 48, the inlet conduits 25, the heat exchangers 23 and 24, and the exit conduits 27, respectively, of FIG. 1. In one embodiment, this allows the cooling system 110 to cool the structure 112 using the fluid coolant including substantially only water. As a result, the heat transfer coefficient of the fluid coolant is substantially higher than it would be if the fluid coolant including a mixture of water and antifreeze was used. Therefore, in one embodiment, the structure 112 is cooled more efficiently. In one embodiment, the structure 112 is cooled as described in FIG. 1. In a further embodiment, once the fluid coolant begins cooling the structure 112, the storage pump 134 stops removing the fluid coolant in liquid form from the loop.

In another embodiment, when the structure 112 is no longer operating, and thus does not need to be cooled by the fluid coolant, the fluid coolant including substantially only antifreeze may be, once again, mixed with the fluid coolant including substantially only water. In one embodiment, the storage pump 134 pumps the fluid coolant including substantially only antifreeze from the storage reservoir 136 and into the vapor line 161, allowing the fluid coolant including substantially only antifreeze to mix with the fluid coolant including substantially only water. This allows the loop to be filled with the fluid coolant including a mixture of antifreeze and water. In one embodiment, the fluid coolant including a mixture of antifreeze and water lowers the freezing point of the coolant mixture. This may, in certain embodiments, prevent the fluid coolant from freezing in many commercial and military applications.

Figure 3:
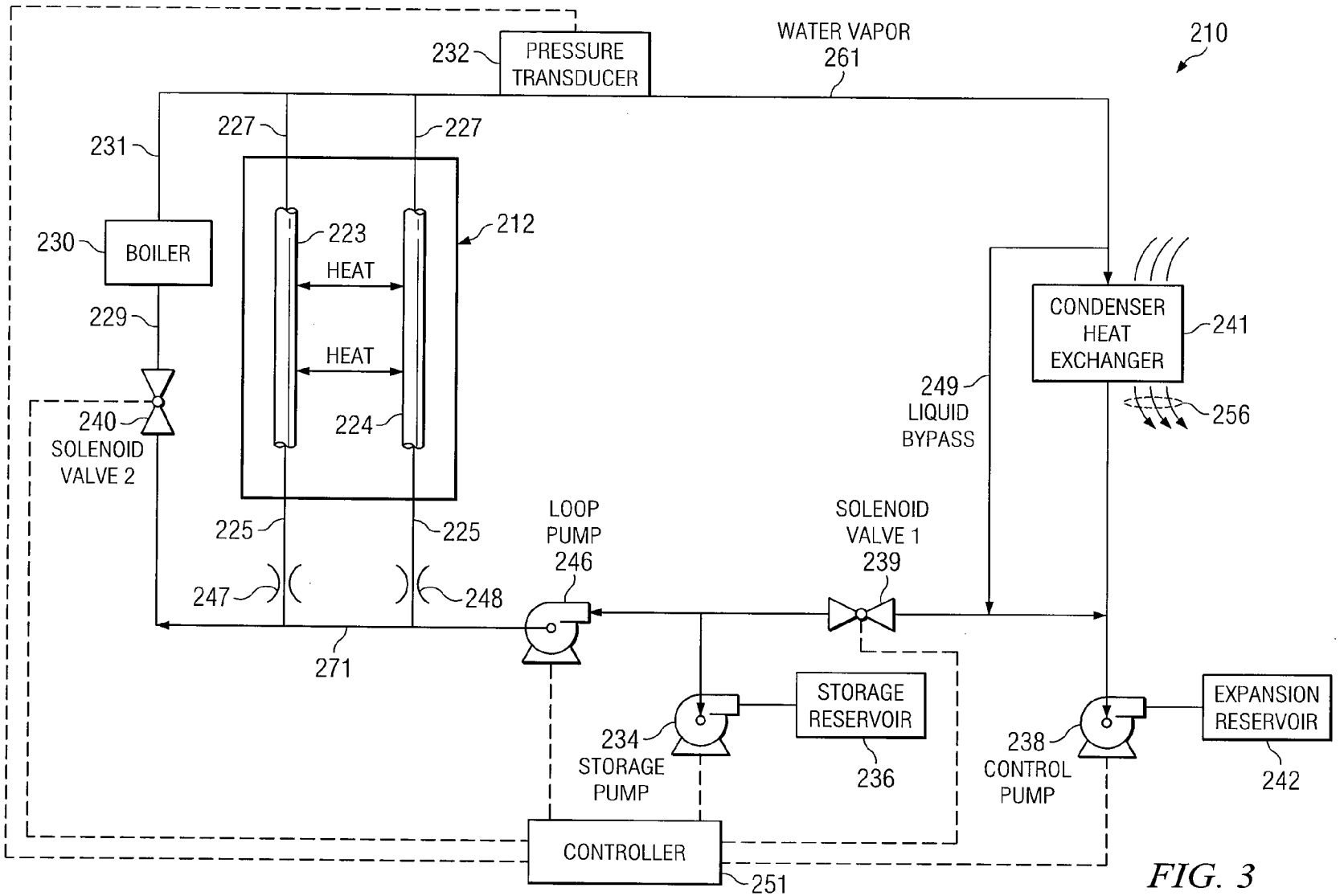
FIG. 3 is a block diagram of another cooling system for cooling a heat-generating structure, according to another embodiments of the invention.

FIG. 3 is a block diagram of a cooling system 210 for cooling a heat-generating structure, according to another embodiment of the invention. In one embodiment, the cooling system 210 includes a heating device 230 for heating a flow of fluid coolant including a mixture of antifreeze and water. The heating device 230, in one embodiment, vaporizes a substantial portion of the water into vapor while leaving a substantial portion of the antifreeze as liquid. In another embodiment, the cooling system 210 further includes an expansion reservoir 242 for storing the substantial portion of the water as liquid. In certain embodiments, this allows the cooling system 210 to separate a fluid coolant including a mixture of antifreeze and water into a fluid coolant including substantially only water and a fluid coolant including substantially only antifreeze. In a further embodiment, the cooling system 210 further includes a control pump 238 for backflushing the fluid coolant including substantially only water through the cooling loop in order to flush the fluid coolant including substantially only antifreeze out of the cooling loop and into a storage reservoir 236. According to one embodiment of the cooling system 210, the fluid coolant including substantially only water is used to cool a heat-generating structure. In another embodiment, the cooling system 210 includes a storage pump 234 for mixing the fluid coolant including substantially only water with the fluid coolant including substantially only antifreeze.

The cooling system 210 of FIG. 3 is similar to the cooling system 10 of FIG. 1. The cooling system 210 further includes the heating device 230, the storage pump 234, the storage reservoir 236, the control pump 238, an expansion reservoir 242, and solenoid valves 239 and 240. The heating device 230 of FIG. 3 is similar to the heating device 130 of FIG. 2. In one embodiment, the heating device 230 may further include a structure 212. The structure 212 of FIG. 3 is similar to the structure 12 of FIG. 1. The cooling system 210 further includes a fluid coolant. The fluid coolant of cooling system 210 of FIG. 3 is similar to the fluid coolant of the cooling system 10 of FIG. 1.

In operation, the heating device 230 is turned on, causing it to generate heat. The structure 212, in one embodiment, is not activated when the heating device 230 is turned on. In a further embodiment, when the heating device 230 is turned on, the expansion reservoir 242 is empty and both the storage reservoir 236 and the cooling loop include a liquid coolant including a mixture of antifreeze and water. The fluid coolant including a mixture of antifreeze and water enters the heating device 230, in liquid form, through a heating device inlet conduit 229. At the heating device 230, absorption of heat from the heating device 230 causes the water in the fluid coolant to substantially vaporize. The antifreeze in the fluid coolant, however, remains substantially in liquid form. In one embodiment, the antifreeze remains in liquid form because antifreeze has a lower vapor pressure than the water.

Once heated, the fluid coolant, which includes both vapor consisting substantially of water, and liquid consisting substantially of antifreeze, departs a heating device outlet conduit 231 and flows through a vapor line 261. The vapor line 261 of FIG. 3 is substantially similar to the vapor line 61 of FIG. 1. A liquid bypass 249 removes the fluid coolant in liquid form, which includes substantially only antifreeze, from the vapor line 261. The fluid coolant in vapor form, which includes substantially only water, enters the condenser heat exchanger 241 where it is condensed back into liquid form. The condenser heat exchanger 241 of FIG. 3 is substantially similar to the condenser heat exchanger 41 of FIG. 1 and can include a flow 256, which is similar to the flow 56 of FIG. 1.

The control pump 238 removes the fluid coolant in liquid form, which consists of the fluid coolant including substantially only water, exiting condenser heat exchanger 241. The control pump 238 stores the fluid coolant in liquid form in the expansion reservoir 242. As a result, the fluid coolant stored in the expansion reservoir 242 includes substantially only water. In one embodiment, as the control pump 238 removes the fluid coolant in liquid form, the storage pump 234 pumps the fluid coolant including a mixture of antifreeze and water from the storage reservoir 236 and into the cooling loop. In one embodiment, this allows the loop pressure to remain at a near constant level.

The fluid coolant including substantially only antifreeze exits the liquid bypass 249, flows into vapor line 261, and returns to the heating device 230 through the heating device inlet conduit 229. At the heating device 230, the fluid coolant, which, in one embodiment, also includes the fluid coolant pumped from the storage reservoir 236, is heated, and the separation process repeats. In one embodiment, this process continues until the expansion reservoir 242 is full of the liquid coolant including substantially only water. In another embodiment, this process continues only until the expansion reservoir 242 includes more of the liquid coolant including substantially only water than can be held in the cooling loop. In one embodiment, the expansion reservoir 242 and the storage reservoir 236 are each capable of holding more fluid coolant than the cooling loop.

In one embodiment, once the expansion reservoir 242 is full of the fluid coolant including substantially only water, the heating device 230 is turned off and the solenoid valve 239 is closed. The control pump 238 then backflushes the fluid coolant including substantially only water through the loop. As a result, the fluid coolant including substantially only water flows through the condenser heat exchanger 241, the vapor line 261, the heating device outlet conduit 231, the heating device 230, the heating device inlet conduit 229, and into the liquid line 271. In one embodiment, the backflushing causes the fluid coolant including substantially only water to force the fluid coolant including substantially only antifreeze into the storage reservoir 236. As a result, in one embodiment, the loop includes substantially only the fluid coolant including substantially only water, while the storage reservoir 236 stores the fluid coolant including substantially only antifreeze. In one embodiment, the backflushing further causes the storage reservoir 236 to also store some of the fluid coolant including substantially only water. In a further embodiment, the backflushing of the fluid coolant including substantially only water empties the expansion reservoir 242.

Once the cooling loop includes substantially only the fluid coolant including substantially only water, the solenoid valve 239, in one embodiment, is reopened, and the solenoid valve 240 is closed. As a result, the fluid coolant including substantially only water flows through inlet orifices 247 and 248, the inlet conduits 225, the heat exchangers 223 and 224, and the exit conduits 227. The inlet orifices 247 and 248, inlet conduits 225, heat exchangers 223 and 224, and exit conduits 227 are substantially similar to the inlet orifices 47 and 48, the inlet conduits 25, the heat exchangers 23 and 24, and the exit conduits 27, respectively, of FIG. 1. In one embodiment, this allows the cooling system 210 to cool the structure 212 using the fluid coolant including substantially only water. As a result, the heat transfer coefficient of the fluid coolant is substantially higher than it would be if the fluid coolant including a mixture of water and antifreeze was used. Therefore, in one embodiment, the structure 212 is cooled more efficiently. In one embodiment, the structure 212 is cooled as described in FIG. 1.

In a further embodiment, when the structure 212 is deactivated, the storage pump 234 pumps the fluid coolant including substantially only antifreeze from the storage reservoir 236 back into the loop. This causes the fluid coolant including substantially only antifreeze to mix with the fluid coolant including substantially only water. As a result, in one embodiment, the fluid coolant including a mixture of antifreeze and water provides freeze protection to the cooling system 210 when not in use. In a further embodiment, after the storage pump 234 mixes the fluid coolant in the cooling loop, the storage reservoir 236 still stores some of the fluid coolant including a mixture of antifreeze and water.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. A cooling system for a heat-generating structure disposed in an environment having an ambient pressure, the cooling system comprising:

a heating device configured to heat fluid coolant comprising a mixture of water and antifreeze and vaporize a portion of the water into vapor while leaving an unvaporized portion of the antifreeze as liquid in the fluid coolant;

a cooling loop configured to direct the fluid coolant to and from the heating device;

a reservoir connected to the cooling loop, the reservoir configured to receive at least some of the unvaporized portion of the antifreeze as liquid from the cooling loop;

a structure configured to reduce a pressure of the fluid coolant to a subambient pressure at which the fluid coolant has a boiling temperature less than a temperature of the heat-generating structure; and a heat exchanger in thermal communication with the heat-generating structure, the heat exchanger having an inlet port and an outlet port, the inlet port configured to receive fluid coolant in the form of a liquid, and the outlet port configured to dispense of fluid coolant out of the heat exchanger in the form of a vapor, wherein heat from the heat-generating structure causes the fluid coolant in the form of a liquid to boil and vaporize in the heat exchanger so that the fluid coolant absorbs heat from the heat-generating structure as the fluid coolant changes state.

2. A cooling system for a heat-generating structure, the cooling system comprising:

a heating device configured to heat fluid coolant comprising a mixture of water and antifreeze and vaporize a portion of the water into vapor while leaving an unvaporized portion of the antifreeze as liquid in the fluid coolant;

a cooling loop configured to direct the fluid coolant to and from the heating device; and a reservoir connected to the cooling loop, the reservoir configured to at least some of the unvaporized portion of the antifreeze as liquid from the cooling loop.

3. The cooling system of claim 2, further comprising:

a heat exchanger in thermal communication with the heat-generating structure, the heat exchanger having an inlet port and an outlet port, the inlet port configured to receive the fluid coolant in the form of a liquid, and the outlet port configured to dispense of a portion of the fluid coolant out of the heat exchanger substantially in the form of a vapor, wherein heat from the heat-generating structure causes the fluid coolant in the form of a liquid to boil and vaporize in the heat exchanger so that the fluid coolant absorbs heat from the heat-generating structure as the fluid coolant changes state, and the cooling loop is configured to direct a flow of the fluid coolant to one or both of the heating device and the heat exchanger.

4. The cooling system of claim 3, further comprising:

a condenser heat exchanger configured to receive the portion of the water as vapor and condense the vapor to liquid for storage in an expansion reservoir.

5. The cooling system of claim 4, further comprising:

a storage pump configured to pump fluid coolant to the cooling loop in an amount commensurate with an amount of liquid stored in the expansion reservoir.

6. The cooling system of claim 3, wherein the reservoir is configured to store the at least some of the portion of the antifreeze as liquid while allowing at least some of the portion of the water as vapor to remain in the cooling loop.

7. The cooling system of claim 6, further comprising:

a controller; and a transducer configured to measure a pressure of the vapor from the one or both of the heating device and the heat exchanger and to send a signal to the controller, wherein the controller is configured to instruct a storage pump to remove the liquid in the fluid coolant into the reservoir at a rate commensurate with a rate of the vapor production from the one or both of the heating device and the heat exchanger.

8. The cooling system of claim 3, wherein the fluid coolant is directed to the heating device until the fluid coolant in the cooling loop has reached a predetermined level of separation between the antifreeze and the water.

9. The cooling system of claim 3, wherein the heat-generating structure is disposed in an environment having an ambient pressure, the cooling system further comprising:

a structure configured to reduce a pressure of the fluid coolant to a subambient pressure at which the fluid coolant has a boiling temperature less than a temperature of the heat-generating structure.

10. The cooling system of claim 2, further comprising:

a mixture sensor configured to sense a percentage of the antifreeze present in the fluid coolant in the cooling loop; and a controller configured to control opening and closing of a valve permitting the fluid coolant to flow to the heating device and then to the reservoir based on the percentage of the antifreeze present in the fluid coolant in the cooling loop.

11. The cooling system of claim 10, wherein the predetermined mixture level is an amount of water pulled out of the cooling loop.

12. The cooling system of claim 10, wherein the predetermined mixture level is an amount less than a defined percentage of antifreeze left in the cooling loop.

13. The cooling system of claim 12, wherein the defined percentage of antifreeze left in the cooling loop is five percent.

14. The cooling system of claim 2, further comprising:

a condenser heat exchanger configured to condense the at least some of the portion of the water as vapor into liquid; and a second reservoir connected to the cooling loop, the second reservoir configured to one of (i) receive at least some of the portion of the water as liquid from the cooling loop or (ii) provide stored water to the cooling loop.

* * * * *